US009392873B2

(12) United States Patent
Gredinger

(10) Patent No.: US 9,392,873 B2
(45) Date of Patent: Jul. 19, 2016

(54) PORTABLE FOOT AND LEG REST

(71) Applicant: Ronen Gredinger, Hollywood, FL (US)

(72) Inventor: Ronen Gredinger, Hollywood, FL (US)

( * ) Notice: Subject to any disclaimer, the term of this patent is extended or adjusted under 35 U.S.C. 154(b) by 0 days.

(21) Appl. No.: 14/505,700

(22) Filed: Oct. 3, 2014

(65) Prior Publication Data

US 2016/0095444 A1 Apr. 7, 2016

(51) Int. Cl.
*A47C 16/02* (2006.01)
*A47C 7/52* (2006.01)

(52) U.S. Cl.
CPC ..... *A47C 7/52* (2013.01)

(58) Field of Classification Search
CPC ..... A47C 7/52
USPC ..... 297/423.4, 423.39
See application file for complete search history.

(56) References Cited

U.S. PATENT DOCUMENTS 1,940,523 A * 12/1933 Barclay ..... A61G 5/00 280/43.17
2,609,864 A * 9/1952 Gates, Jr. ..... A61G 5/12 297/423.19
2,735,480 A * 2/1956 Mead ..... 297/423.39
2,983,310 A * 5/1961 Warlick et al. ..... 297/399
3,114,527 A * 12/1963 Demarest ..... 248/118
3,129,975 A * 4/1964 Emery ..... 297/397
3,167,351 A * 1/1965 Butler ..... 297/423.4
3,507,538 A * 4/1970 Stoller ..... 297/410
3,865,427 A * 2/1975 Delany ..... A61G 3/06 280/30
4,564,238 A * 1/1986 Wolpert, Jr. ..... A47C 7/52 297/423.19
4,695,072 A * 9/1987 Brooks ..... A61G 1/013 280/47.25
5,121,969 A * 6/1992 Schroeder ..... 297/397
5,378,041 A * 1/1995 Lee ..... 297/391
5,904,406 A * 5/1999 Stewart ..... 297/397
6,511,126 B1 * 1/2003 McAdams ..... 297/217.1
6,860,557 B2 * 3/2005 Jonasson ..... 297/253

* cited by examiner

*Primary Examiner* — Rodney B White

(57) ABSTRACT

This invention, a portable foot and leg rest which allows a person to sit on a standard couch with unattached cushions all while having person's legs rest horizontally on the portable foot and leg rest. The portable foot and leg rest is horizontally adjustable with telescoping parts to accommodate different leg lengths of users. This device has a cushion that can be taken off, and the frame of the device can be reduced to a smaller size by telescoping, in order to be mainly hidden underneath couch cushion while not in use. The portable foot and leg rest is not a complex device and not bulky. Therefore this lightweight device can be transported from one sitting area to another without being permanently attached to a couch.

5 Claims, 4 Drawing Sheets

PORTABLE FOOT AND LEG REST

SUMMARY OF THE INVENTION

With the above and other objects in view, a portable foot and leg rest according to the present invention includes two elongated U shaped metal pipe frames having opposed first and second ends. Facilities at the first U shaped metal pipe frame, rest on top of the frame of a couch while underneath a couch cushion. The secondary U shaped pipe frame which supports the legs or feet of the user slides in and out of the inside pipe diameter of the main U shaped pipe frame, by telescoping the legs of both U shaped pipe frames. A rectangular prism shaped cushion with a hole in the middle of the cushion along with a slit in the center of the bottom of said cushion, made to fit around the middle section of the secondary U shaped pipe frame. Said cushion has a cloth exterior, on the cloth exterior is an attached first zipper, the length of zipper starts from the corner of the width section of said cushion and covers three side areas of the rectangular prism shaped cushion, in order to open for foam to be removed. A second zipper is attach to the corner section of said slit, to allow for fastening cushion around the secondary U shaped pipe. The rectangular prism shaped cushion is for the legs or feet of a user to rest on horizontally while sitting on couch.

DETAILED DESCRIPTION

Figure 1:
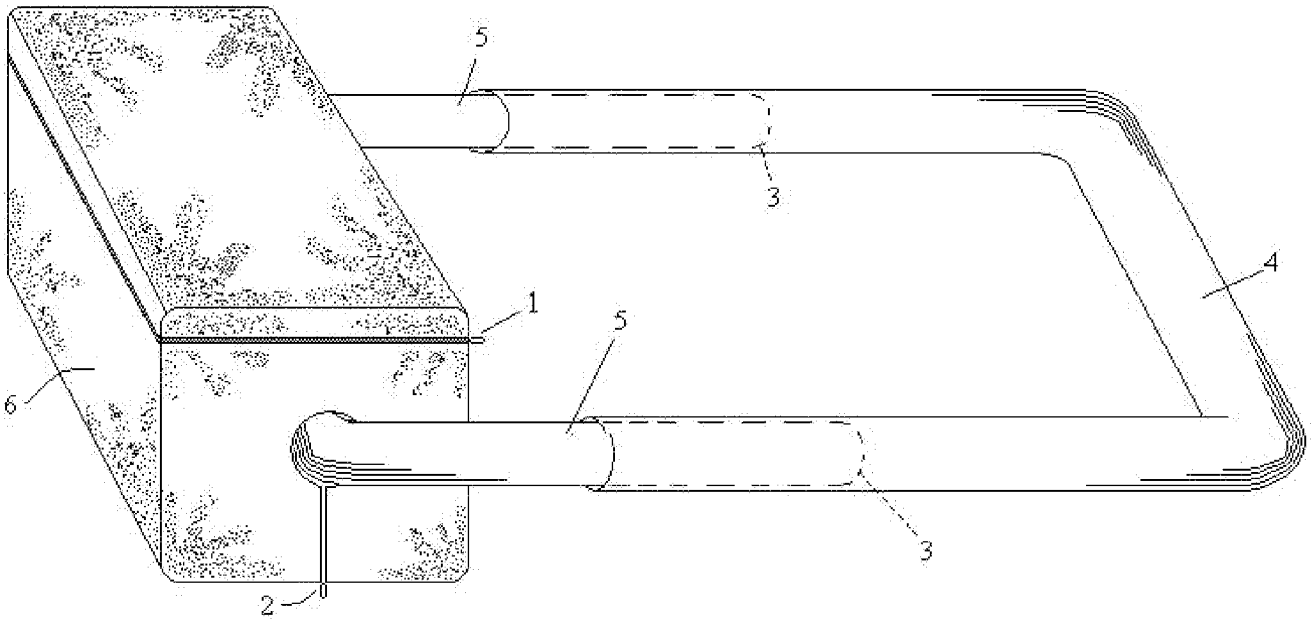
FIG. 1 is an above side angle view of the foot and leg rest in the partially collapsed condition.

FIG. 1 is an above side angle view of the foot and leg rest, according to the present invention, in which a rectangular prism shaped cushion 6 is wrapped around U-frame pipe 5. Said cushion 6 has a cloth exterior which has an attached zipper 1 located on the side top area of said cushion 6, length of said zipper 1 starts from the corner of width section of said cushion 6 and covers three side areas of said cushion 6. In the corner area of the slit on the bottom of cushion 6 there is a zipper 2 that can fasten cushion 6 to U-frame pipe 5. The middle section of U-frame pipe 5 is hidden from plain view inside cushion 6. The two legs of U-Frame pipe 5 which run parallel to each other are inserted into the inside diameter of the two legs of U-frame pipe 4 in the partially collapsed view 3.

Figure 2:
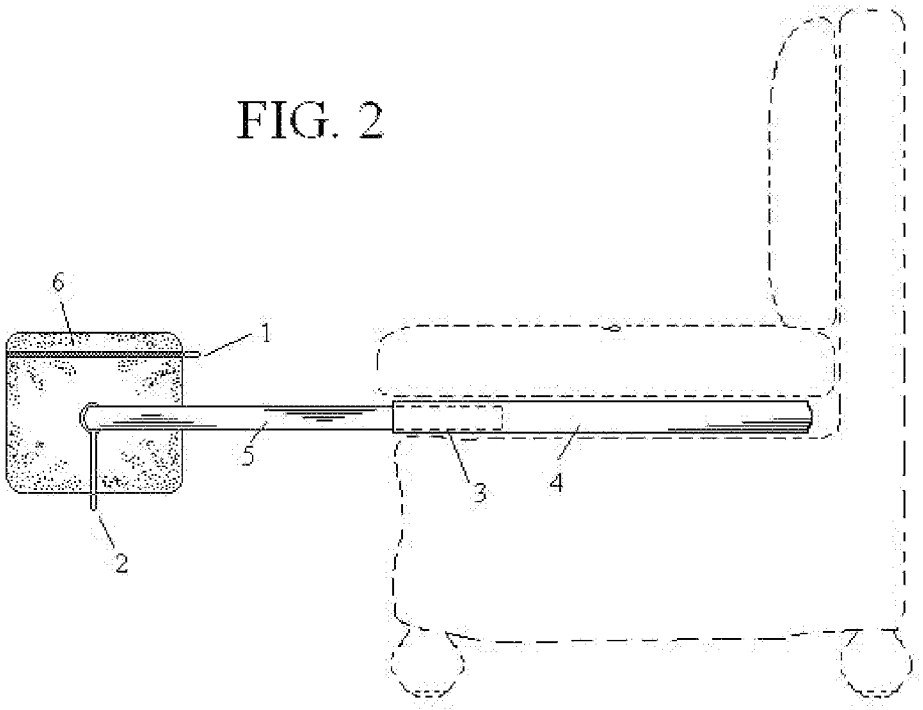
FIG. 2 is a side view of FIG. 1, the portable foot and leg rest which lies on a frame of a couch, and underneath the couch cushion in the partially extended condition.

FIG. 2 shows a side view of a foot and leg rest in the partially collapsed view 3. The U-frame pipe 4 lies in-between a couch frame and couch cushion, and the legs of said U-frame 4 are facing toward the outer edge of the couch. U-frame pipe 5 legs are partially inserted into the inside diameter of said U-frame 4 legs in the partially collapsed view 3. Said cushion 6 has a cloth exterior which has an attached zipper 1 for foam from said cushion 6 to be removed. Said cushion 6 is wrapped around said U-frame 5, and can be fastened with zipper 2 located on the corner area of the slit part of said cushion 6. Said U-frame 5 extends out with said cushion 6 for the user's legs or feet to rest on while user is sitting on the couch.

Figure 3:
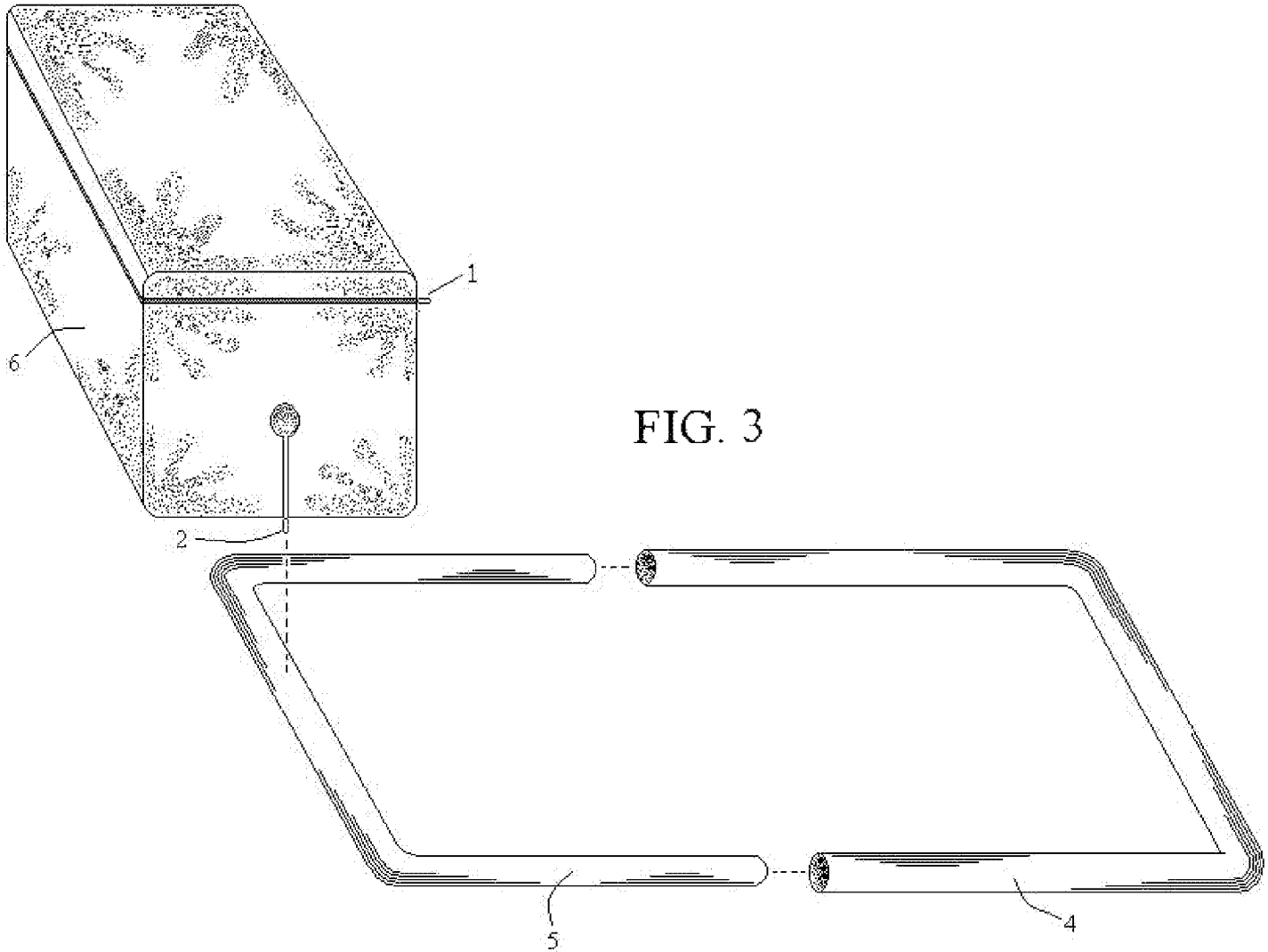
FIG. 3 is a above side angle view of FIG. 1, the rectangular prism shaped cushion is unattached to the frame and the main frame separated from the secondary frame.

FIG. 3. shows a above side angle view of all parts of the foot and leg rest which are separated from each other. The first part is the rectangular prism shaped cushion 6 made out of foam with a cloth exterior which has an attached zipper 1 for foam from cushion 6 to be removed. Said cushion 6 has a center hole formed running parallel with the extensive area of said prism cushion 6. There is a slit cut from said center hole to the bottom side of the prism cushion 6 which is connected together with said center hole which runs from one length end to the other length end of said cushion 6, in order to form an opening. Zipper 2 is attached to the corner section of said slit part of said cushion 6. The second part is the U-frame metal pipe 5, and the third part is the U-frame metal pipe 4.

Figure 4:
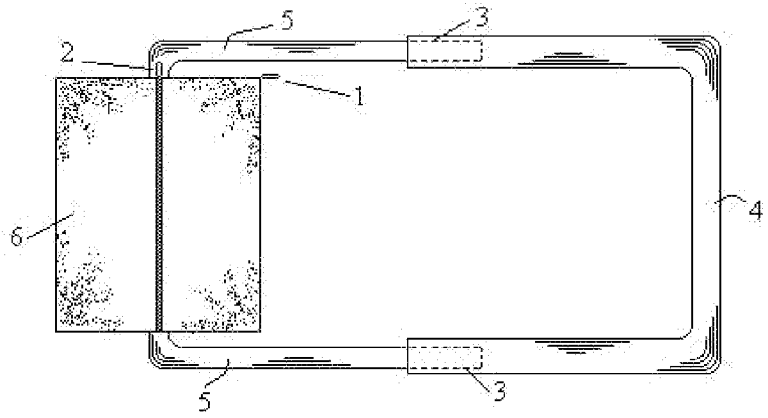
FIG. 4 is a bottom view of FIG. 1 according to the present invention with the foot and leg rest shown in the partially collapsed condition. A zipper is shown on the bottom, attached to rectangular prism shaped cushion.

FIG. 4 shows the bottom view of a foot and leg rest according to the present invention, U-frame 5 is mainly hidden from plain view when cushion 6 is wrapped around the middle section of U-frame pipe 5 through said hole in cushion 6 and secured with zipper 2, attached to the corner area of said slit on the bottom of cushion 6. Zipper 1 handle is shown from the bottom view. The two legs of said U-frame pipe 5 are hidden inside the two legs of U-frame pipe 4 which is shown in the partially collapsed condition 3.

I claim:

1. A portable foot and leg rest, selectively attachable to a chair or couch, comprising:

a first elongated metal pipe U-shaped frame, adapted for selectively and temporarily resting said U-shaped frame on a chair or couch;

a second elongated metal pipe U-shaped frame similar in size and having a smaller diameter than the first U-shaped frame, for permitting selective sliding movement within the first elongated U-shaped frame towards the chair or couch or away from the chair or couch;

a rectangular prism-shaped cushion parallel to and supported by a middle section of said second elongated metal pipe U-shaped frame;

said rectangular prism-shaped cushion having a lengthwise center pierced hole;

a lengthwise level slit extending from an outer bottom side surface to the center pierced hole of said prism cushion and creating two opposing walls and forming a space between the walls, the space having a minimum gap width;

a removable fabric cover which fits snugly around the entire outer surface of said rectangular prism-shaped cushion;

a first zipper on said fabric cover which leads around two width sides and one length side of said prism-shaped cushion and located near a top of said prism cushion;

a lengthwise second zipper on said removable fabric cover located on a center bottom side of said prism-shaped cushion;

the first zipper on said removable fabric cover for opening a top of said fabric cover for allowing said prism-shaped cushion to be separated from said fabric cover; and the second zipper on said removable fabric cover securing said rectangular prism-shaped cushion and firmly attaching said rectangular prism-shaped cushion to said middle section of the second metal pipe U-shaped frame.

2. A portable foot and leg rest according to claim 1, wherein the first and second elongated pipe U-shaped frames consist of a first leg member and a second leg member which is parallel to the first leg member conjoined with a section interconnecting one end of each of said leg members.

3. A portable foot and leg rest according to claim 2, wherein the first and second leg members of said second elongated pipe U-shaped frame slide within the respective first and second leg members in said first elongated pipe U-shaped frame.

4. A portable foot and leg rest according to claim 1, wherein the first and second elongated metal pipe U-shaped frames can be taken apart or collapsed for easy transport to another place.

5. A portable foot and leg rest according to claim 1, wherein said rectangular prism-shaped cushion can be easily installed and removed by the user manually widening the gap made from the slit, wherein said rectangular prism cushion is slidable on or off from said middle section of the second metal pipe U-shaped frame.

* * * * *